United States Patent [19]

Johnson

[11] 4,454,667

[45] Jun. 19, 1984

[54] SNOW REMOVAL AND COMPACTION DEVICE

[76] Inventor: Vendell J. Johnson, 17136 Town Line Rd., Minnetonka, Minn. 55343

[21] Appl. No.: 502,450

[22] Filed: Jun. 9, 1983

[51] Int. Cl.[3] ..... B30B 7/04

[52] U.S. Cl. ..... 37/225; 100/100; 100/139; 100/145; 100/178

[58] Field of Search ..... 37/225, 237; 100/100, 100/137, 138, 139, 145, 177, 178

[56] References Cited

U.S. PATENT DOCUMENTS

| | | | |
|---|---|---|---|
| 2,193,140 | 3/1940 | Mortenson | 100/178 |
| 3,765,321 | 10/1973 | Newell | 37/225 X |
| 3,796,147 | 3/1974 | Richardson | 37/225 X |
| 4,145,824 | 3/1979 | Watson | 100/100 X |

*Primary Examiner*—Billy J. Wilhite

[57] ABSTRACT

A compact snow removal apparatus for continuously removing snow from a generally horizontal surface. The snow is then compacted to substantially remove all air and reduce it to ice or an ice-like substance. The apparatus employs several steps to achieve the compaction. By addition of accessories the ice pieces may be tossed to the side, stored in a container within the apparatus or conveyed to the box of a truck to which the snow removal device is attached or adjacent.

4 Claims, 8 Drawing Figures

SNOW REMOVAL AND COMPACTION DEVICE

BACKGROUND OF THE INVENTION

This invention relates to a snow removal device for removal of snow from a generally horizontal surface such as a roadway, sidewalk or parking lot surface in a continuous fashion as it moves along the surface. More particularly it relates to a snow removal device which compacts the snow to be removed to ice or an ice-like substance so that it will occupy a much smaller space than would the snow itself.

In U.S. Pat. No. 3,765,321 a snow compressor is shown. Snow is dumped into a hopper at the top of the device and hydraulically pushed plates compress the snow. It requires equipment to pull it about as well as additional equipment to collect the snow and load it into the compressor.

In U.S. Pat. No. 3,796,147 a snow removal and compacting device is shown which employs a snowblower to fill open topped chambers which are then closed and a compression plate compresses the snow. The many moving parts and need to recollect "excess snow" are disadvantages.

Accordingly, it is an object of the present invention to provide a mobile and compact snow removal and compaction apparatus capable of continuous snow removal as it snows across a surface with minimal need for intermediate handling of snow after it is collected from the surface being cleared.

It is another object of the invention to provide a mobile snow removal and compaction apparatus which achieves compaction in a series of stages.

It is still another object of the invention to provide a mobile snow removal device which is not subject to jamups.

It is yet another object of the invention to provide a mobile snow removal device which is compact in its construction so that it may by attached to the front of a car or truck in much the same fashion as is a snowplow.

It is a further object of the invention to provide a snow removal device which will through a series of compaction stages reduce the material on which it is operating to ice or a substantially ice-like material.

DESCRIPTION OF THE PREFERRED EMBODIMENT

Figure 1:
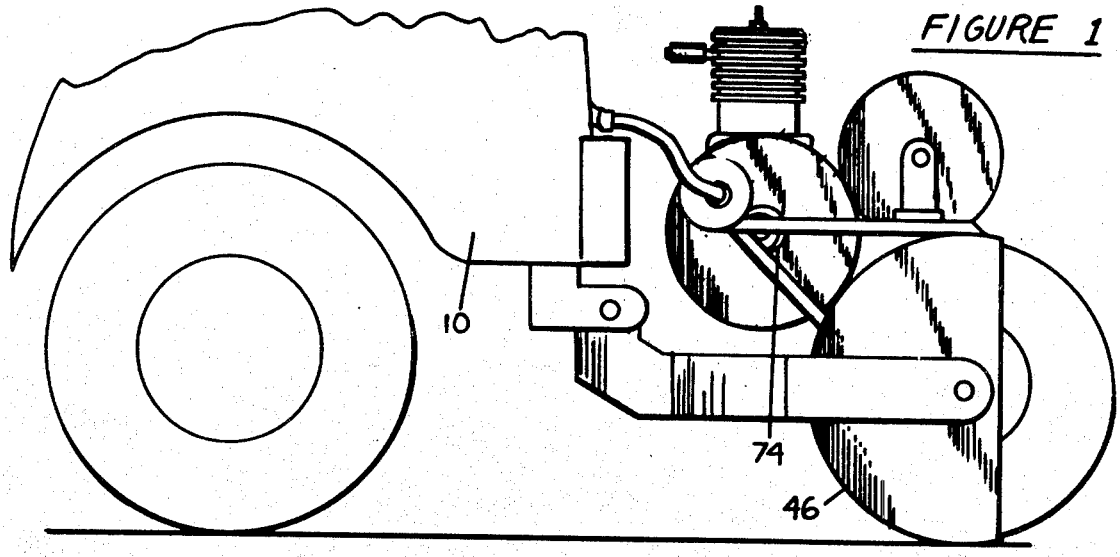
FIG. 1 is a side elevation of the snow removal device of this invention mounted to the front of a truck.
Figure 2:
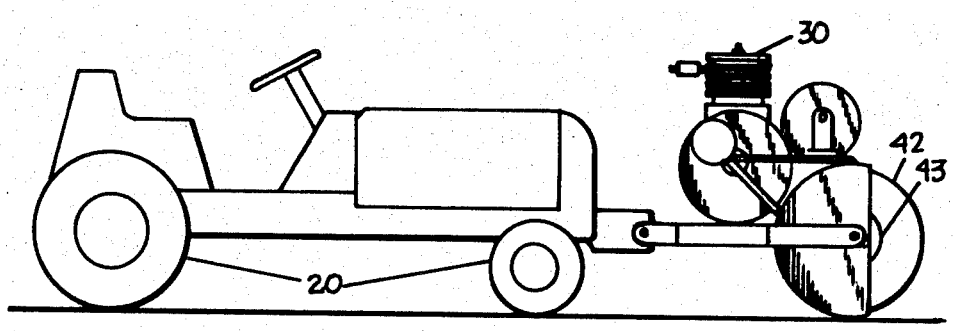
FIG. 2 is a side view of the snow removal device of this invention in a self propelled embodiment.
Figure 3:
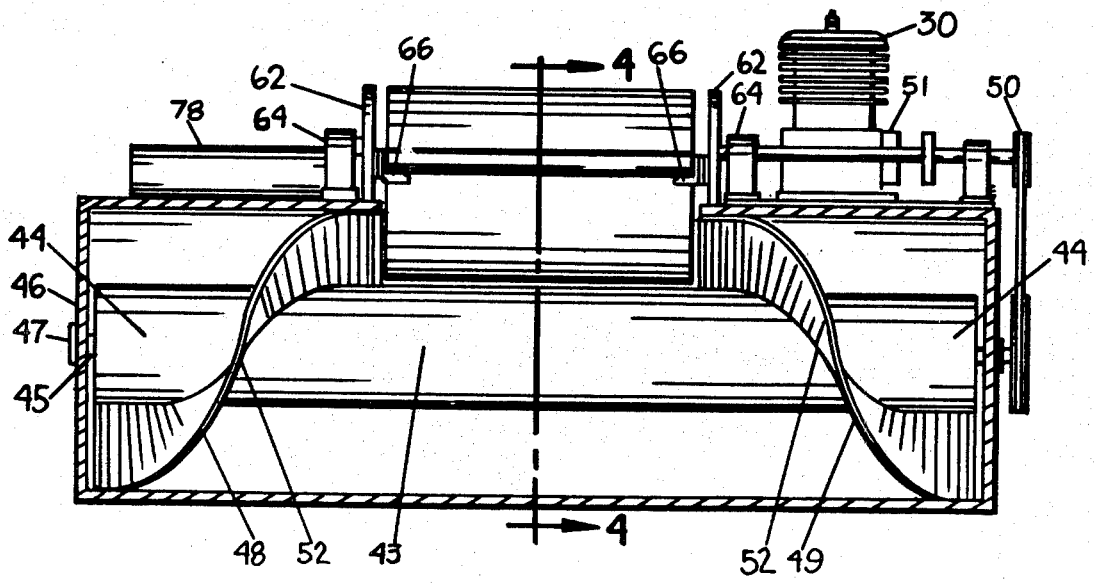
FIG. 3 is a front elevation of the snow removal device of this invention mounted to the front of a truck.
Figure 4:
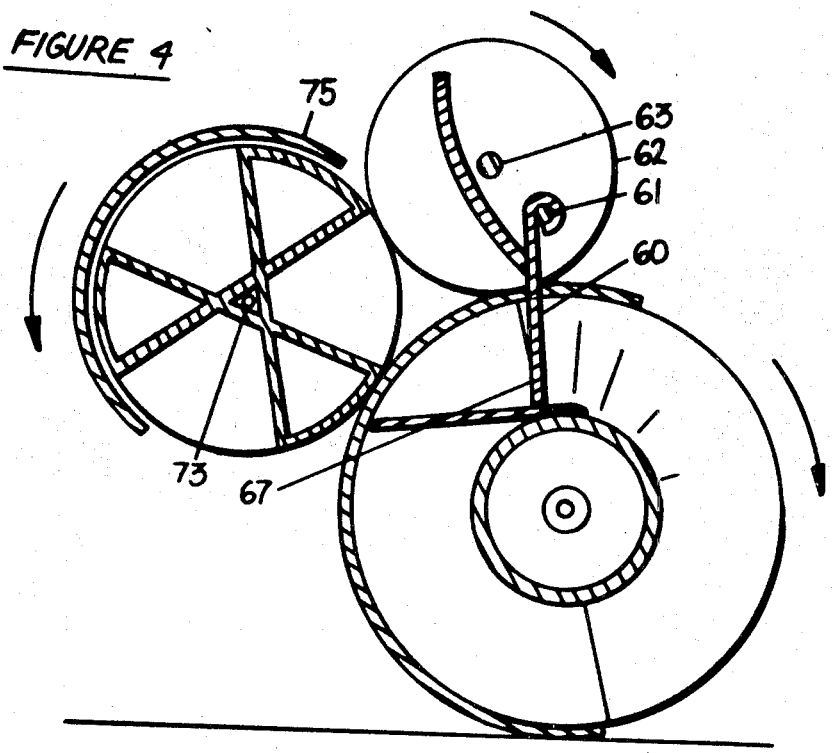
FIG. 4 is a sectional view taken on line 4—4 of FIG. 3.
Figure 5:
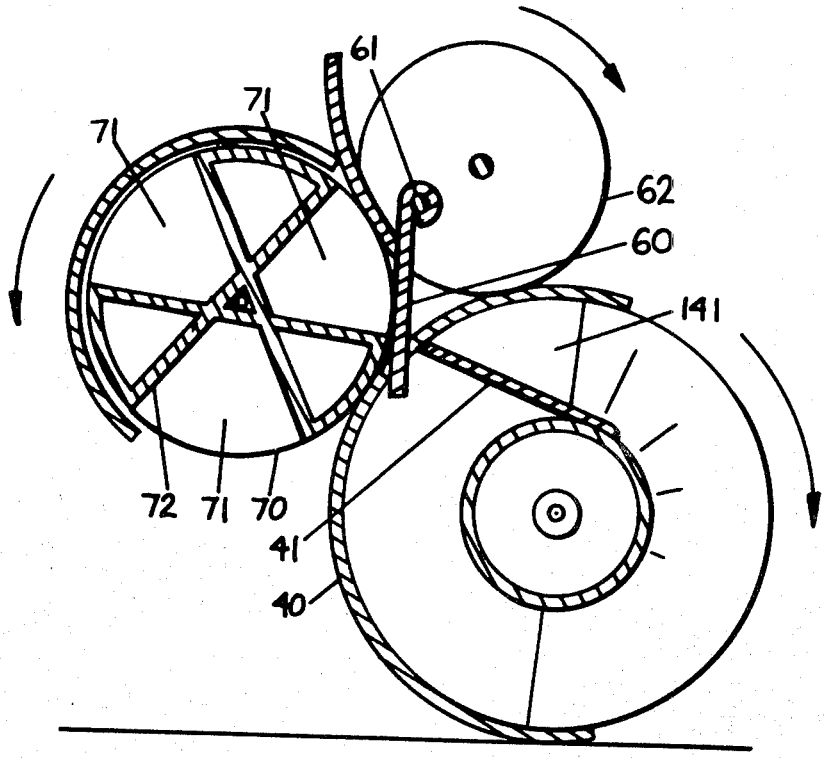
FIG. 5 is a view on the same section as that of FIG. 4 showing a different portion of the operating cycle.

Referring to FIGS. 1 and 2, a preferred embodiment of the invention is shown therein. The snow removal device is shown mounted to the front of a truck 10. Alternatively the present invention is mounted on wheels 20 and is self-propelled.

The snow removal and compaction device which is the subject of the present invention is indicated generally by the numeral 25. It employs three compaction stages to achieve uniform and fairly complete compaction of snow to remove air from the snow so that it may be stored in a much smaller space than uncompacted snow as well as to allow for easier handling.

The first compaction stage is achieved with a double bladed auger 42 which is transverse to the direction of motion of the device of the present invention. Auger 42 takes snow from the surface over which it is traveling and urges it from the sides toward the center of the auger 42. A motor 30 is shown mounted to auger housing 40 which partially encloses auger 42 within it. Auger 42 is driven by means of a drive train 50 which in the truck mounted embodiment shown at FIGS. 1 and 2 serves to reduce the rotational velocity of the motor shaft 31. The drive train 50 employs a gear reduction drive 5 in conjunction with drive belts 55 and pulleys 56 to cause auger 42 to rotate at reduced speed and with increased power. Drive belts 55 and pulleys 56 may have teeth for more positive control or may be replaced with chains and sprockets.

Auger 42 is formed of a long thin central drum 43 of metal which has stub shafts 45 attached to the two ends 44 of the drum 43. The stub shafts 45 are rotatably mounted in bearings 47 attached to auger housing ends 46. Housing 40 is made of rolled metal and is formed into the shape of a section of a cylinder which is open at the front and central portion of the top. The central axis of this section of cylinder is also the central axis of central drum 43 so that the two are coaxial. Welded onto central drum 43 are two blades 48 and 49 which are of a helical contour. It may be seen that the right hand blade 48 and the left hand blade 49 may be seen to have opposite curvature. That is one is in the shape of a right handed helix while the other is in that of a left handed helix. The result is that when auger 42 turns in a direction which is seen as clockwise when looking at auger 42 from the right side the blades 48 and 49 will tend to impel any material within or slightly infront of housing 40 from the sides toward the center. Blades 48 and 49 terminate at the central ends in a juncture with inner end plates 141. The end plates 141 are perpendicular to the axis of auger 42 and extend rearwardly from the inner ends of auger blades 48 and 49. A flat platform 41 is attached to the central portion of auger drum 43 and connects the rearward edges of end plates 141. The flat platform 41 is tangential to the central portion of auger drum 43 at its point of attachment thereto and extends almost to a point of contact with housing 40.

Flat platform 41 receives the material from the auger screws 52 adjacent it on either side and urges it in its direction of travel which is about the axis of central drum 43 in a clockwise direction as seen from the right. All of this action is very similar to that which occurs in the initial stage of an auger type snowblower of conventional construction except for the flat platform 41. The auger action picks up snow from the surface over which it is traveling and urges it toward the center of the housing 40. There is some degree of compaction of the snow being operated upon as it is urged toward the center from the sides.

The device of the present invention will also operate without the auger blades 48 and 49 and with a correspondingly shorter central drum 43 and housing 40, although a narrower path will be covered and there will be no first stage of compaction by the auger. Of course, the best results will result with the inclusion of the auger.

In the present invention as flat platform 41 moves upwardly on the back of central drum 43 pushing snow ahead and above it, paddle 60 mounted to paddle shaft 61 moves in a generally front to back action conveying the snow from flat platform 41 in a front to back direction as flat platform 41 is moving upwardly. Paddle shaft 61 is attached at its ends to a pair of discs 62. The point of attachment is partway out from the center to the edge of the discs 62. Discs 62, in turn, are mounted to a shaft 63 which passes through the centers of discs 62 so the discs 62 and shaft 63 have a configuration like that of wheels upon an axle. Shaft 63 is mounted at its ends to bearings 64 affixed above drum 43 to a subframe 65 which in turn is attached to the housing 40 so paddle 60 rotates with it. Shaft 63 rotates in the same direction as auger 42. As shaft 63 turns it causes paddle 60 which is at the lowest point of its travel, to move rapidly from front to back over flat platform 41 to remove the snow from it and convey it in a backward direction. In the preferred embodiment shown, paddle 60 and the drive mechanism including the shaft 53, discs 62 and paddle shaft 61 causes paddle 60 to move more rapidly than does flat platform 41 on auger 42. The drive mechanism is synchronized with the drive of auger 42 so that shaft 63 rotates twice as rapidly as does auger 42. Paddle 60 may be seen to move about an axis which is parallel with that of auger 42. Paddle 60 is spring loaded by paddle spring 66 which urges paddle 60 to a forward position. The spring loading and rapid motion of paddle 60 serve to cause the forward edge 67 of paddle 60 to ride over flat platform 41 taking with it almost all of the snow which has collected there due to the action of auger blades 48 and 49 forcing snow inwardly from the sides to rectangular flat platform 41. In the present embodiment, paddle 60 which is rotatably affixed to paddle shaft 51, discs 62 and central shaft 63 rotates generally with central shaft 63 which rotates twice as fast as does auger 42. In this present embodiment paddle 60 is idle on every second rotation and serving to convey snow on only half of its rotations.

Figure 6:
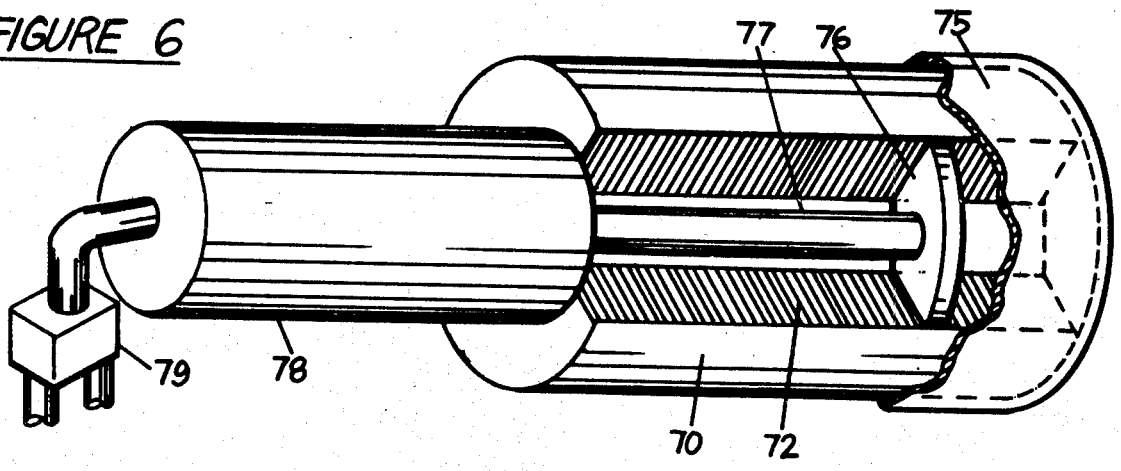
FIG. 6 is a perspective view of the compaction drum and other elements of the third stage of compaction.
Figure 7:
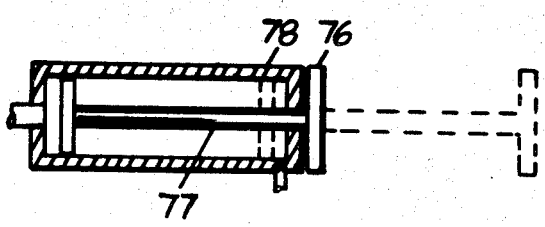
FIG. 7 is a detail view of the compression piston and associated hydraulic cylinder.

After sweeping across flat platform 41 paddle 60 is in covering location over the open side of hollow chamber 71. Paddle 60 urges the snow into longitudinal hollow chamber 71 in compaction drum 70 under pressure as it approaches it. This accomplishes a second stage of compaction. Compaction drum 70 may have one or more hollow chambers 71. By employing a plurality of hollow chambers 71, it is possible to have several separate steps performed simultaneously in the various chambers. In the preferred embodiment three chambers 71 are formed in compaction drum 70. The chambers 71 are generally wedge shaped and are formed into compaction drum 70 with long dimension parallel to the axis of compaction drum 70 as may best be seen at FIG. 6. Chambers 71 are open at one end and at one side. They are closed at one end and on two sides 72, which sides 72 are formed within compaction drum 70. The three compaction chambers 71 are equally spaced about compaction drum 70. When viewed from the end of compaction drum 70, only the circular face of one end of drum 70 is seen. The chambers 71 are seen as open areas much as if one had cut three pieces out of a pie without cutting to the middle. The result is that there is a continuous section of material between the portions cut out.

Figure 8:
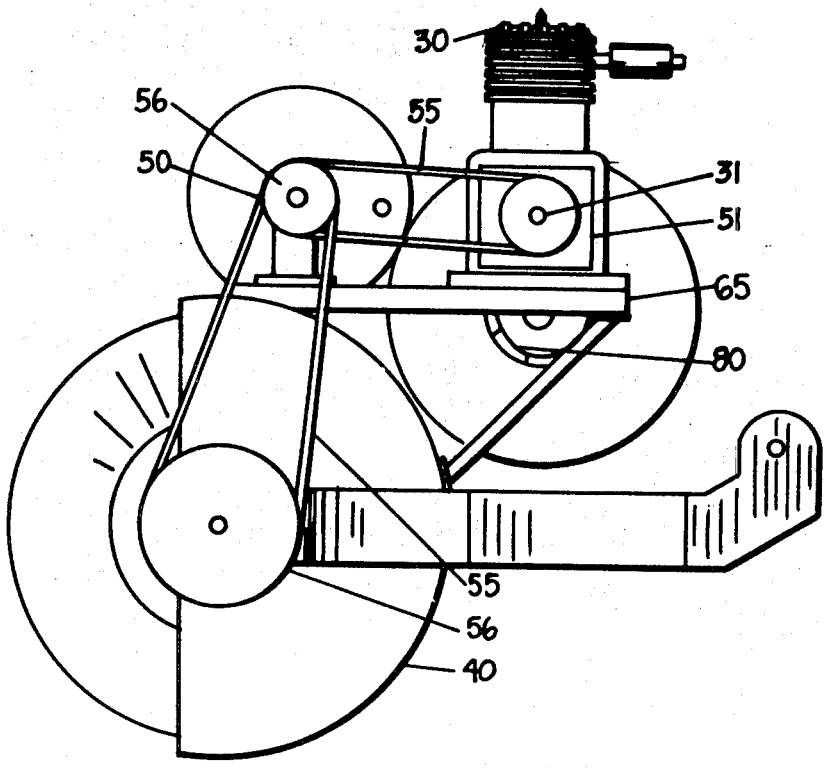
FIG. 8 is a side elevation of the snow removal device showing the side opposite that shown at FIG. 1 showing the motor and drive train.

The compaction drum 70 has stub shafts 73 at its ends which are mounted to bearings 74 which are mounted to subframe 65 so the compaction drum 70 may rotate about its axis. Compaction drum drive motor 80 is shown at FIG. 8. It is attached to subframe 65 and is on a common axis with compaction drum 70 so that its shaft is coupled directly to the stub shaft on that side. In the present embodiment a hydraulic motor 80 is shown. The compaction drum remains stationary while one chamber 71 is receiving snow from paddle 60. After paddle 60 has loaded the chamber 71, compaction drum 70 rotates one third revolution so that a new chamber 71 is moved into position to receive snow from paddle 60. About the top and back of compaction drum 70 is an enclosure 75 which is in the form of a fractional cylinder. As compaction drum 70 rotates, the newly loaded cylinder moves to a position beneath enclosure 75 which closes off the open side of the chamber 71 so that it is only open at the one end. Immediately adjacent the open end of compaction chamber 71 in this position beneath enclosure 75 is a compacting piston 76 which is parallel with the end of compaction drum 70. Compaction piston 76 is mounted to piston shaft 77. Piston shaft 77, in turn is attached to a hydraulic cylinder 78. Actuation of hydraulic cylinder 78 causes compaction piston 76 to enter and travel into compaction chamber 71 from one end forcing the snow ahead of it to be compressed under great pressure toward the other end of the compaction chamber 71.

The end of the compaction stroke of compaction piston 76 may be determined by a simple preset distance determined by the travel of hydraulic cylinder 78 or by means of a release actuated by a pressure limit valve 79. After the compaction stroke is completed, compaction piston 76 returns to its rest position outside and immediately adjacent the open end of compaction chamber 71 leaving a compressed mass at the end of compaction chamber 71, which mass is in the form of ice or an ice like substance, which will simply be called ice. When the compaction drum makes its next one third revolution, the compaction chamber 71 holding the newly compressed mass of ice will rotate with the compaction drum 70 to a position at the bottom of the compaction drum and beyond the edge of enclosure 75. At this point gravity will cause the mass of ice to fall from compaction chamber 71. The next one third revolution of the compaction drum 70 will bring the empty compaction chamber 71 to the original location described to again be loaded with snow by paddle 60.

Each of the three positions described above will at any given time be occupied by one of the three compaction chambers 71 so that each of the three functions ascribed to the various positions will be occurring simultaneously.

The blocks of ice which fall from the compaction drum 70 upon each cycle of the drum 70 may be dealt with in a variety of ways. A simple conveyor mechanism may be used to push the blocks to the side. An accumulator or container may be employed to hold the blocks of ice until they may be taken to a place to be dumped such as the corner of a parking lot. A conveyor such as a belt conveyor may be employed to move the blocks of ice to the box of a truck 10 to which the snow removal device is attached or to one adjacent. A combination accumulator and conveyor may also be employed combining more than one of the above functions.

While I have shown and described an embodiment of this invention in some detail, it will be understood that this description and illustrations are offered merely by way of example, and that the invention is to be limited in scope only by the appended claims.

Having disclosed and described a preffered embodiment of the invention, what I claim to be new and desire to protect by United States Letters Patent is:

1. A mobile snow removal and compaction device to remove snow from a surface over which it is moving comprising:

a subframe, a cylindrical housing attached to the subframe and transverse to the direction of motion of the device having an opening at the front and top, a first drum of smaller diameter than the cylindrical housing coaxially and rotatably mounted within the housing, removal means on said first drum to pick up snow from said surface, a flat rectangular platform affixed tangentially to the drum and extending almost to the cylindrical housing, a compaction drum with axial parallel to that of the first drum rotatably mounted adjacent and behind the opening at the top of the cylindrical housing which compaction drum has formed within one side of it a longitudinal hollow chamber which chamber is open along the side and one end, a paddle rotatable about an axis parallel to that of the first drum and connected to the subframe above the first drum, drive means connecting the paddle and first drum to synchronize their motions so the paddle sweeps across the flat platform as it rotates through a predetermined portion of its travel and which paddle after such sweep is in covering location over the side of the longitudinal hollow chamber, and a piston mounted adjacent the open end of the longitudinal hollow chamber which may be activated to travel into the chamber toward the other end of the chamber.

2. The snow removal and compaction device of claim 1 wherein the first drum and housing are longer than the paddle and compaction drum and wherein said removal means comprises auger blades about the end portions of the first drum to urge snow from the sides to the flat platform at the center of the first drum.

3. The snow removal and compaction device of claim 1 further comprising a motor to rotate the compaction drum about its axis.

4. The snow removal and compaction device of claim 3 wherein the compaction drum has three longitudinal hollow chambers about its periphery and further comprising an enclosure about the top and back of the compaction drum and wherein the piston is adjacent the open end of the chamber beneath the enclosure.

* * * * *